US011359645B2

(12) United States Patent
Chavez Castellanos et al.

(10) Patent No.: US 11,359,645 B2
(45) Date of Patent: Jun. 14, 2022

(54) COMPRESSOR WITH COOLED AIR PASSAGE AND LIQUID COOLANT PASSAGE IN AXIAL HEAT EXCHANGER ARRANGEMENT

(71) Applicant: Garrett Transportation I Inc, Torrance, CA (US)

(72) Inventors: Carlos Chavez Castellanos, Rolling Hill Estates, CA (US); Adonis Spathias, Glendora, CA (US); Kristian Dullack, Torrance, CA (US); Manuel Gonzalez, Los Angeles, LA (US)

(73) Assignee: GARRETT TRANSPORTATION I INC, Torrance, CA (US)

( * ) Notice: Subject to any disclaimer, the term of this patent is extended or adjusted under 35 U.S.C. 154(b) by 43 days.

(21) Appl. No.: 16/820,861

(22) Filed: Mar. 17, 2020

(65) Prior Publication Data

US 2021/0293253 A1 Sep. 23, 2021

(51) Int. Cl.
*F04D 29/58* (2006.01)
*F04D 25/06* (2006.01)
(Continued)

(52) U.S. Cl.
CPC ..... *F04D 29/5806* (2013.01); *F04D 25/06* (2013.01); *F04D 29/5826* (2013.01);
(Continued)

(58) Field of Classification Search
CPC .. F04D 29/5806; F04D 29/5826; F04D 29/62; F04D 29/5866; F04D 25/06; F04D 29/046; F04D 29/047; F04D 29/0473; F04D 13/0653; F04D 29/441; F04D 29/057; F04D 29/051; F04D 29/4206; F04D 17/04;
(Continued)

(56) References Cited

U.S. PATENT DOCUMENTS 9,863,430 B2 1/2018 Lee
2011/0150637 A1* 6/2011 Radermacher ..... F04D 29/584 415/178
(Continued)

FOREIGN PATENT DOCUMENTS

DE 102018201162 A1 7/2019
WO 2013187786 A1 12/2013
WO 2019087868 A1 5/2019

*Primary Examiner* — Kenneth J Hansen
*Assistant Examiner* — David N Brandt
(74) *Attorney, Agent, or Firm* — Lorenz & Kopf LLP

(57) ABSTRACT

A compressor device includes a motor cooling system that provides a first flow of a first fluid through a housing for cooling a motor. The motor cooling system includes a first fluid flow section at a first axial position. The first fluid flow section extends in a downstream direction radially with respect to the axis of rotation. Also, the device includes a bearing cooling system that provides a second flow of a second fluid through the housing for cooling the bearing. The bearing cooling system includes a second flow section at a second axial position that is spaced apart axially from the first axial position. The second flow section extends in a downstream direction radially with respect to the axis of rotation. The first flow section and the second flow section are disposed in a heat exchanger arrangement configured to transfer heat between the second fluid and the first fluid.

18 Claims, 5 Drawing Sheets

(51) Int. Cl.

| | |
|---|---|
| ***F04D 29/62*** | (2006.01) |
| ***F04D 13/06*** | (2006.01) |
| ***F04D 17/04*** | (2006.01) |
| ***F04D 29/047*** | (2006.01) |
| ***F04D 29/051*** | (2006.01) |
| ***F04D 29/057*** | (2006.01) |
| ***F04D 29/42*** | (2006.01) |
| ***F04D 29/44*** | (2006.01) |
| ***F04D 29/60*** | (2006.01) |

(52) U.S. Cl.
CPC ..... *F04D 29/5866* (2013.01); *F04D 29/62* (2013.01); *F04D 13/0653* (2013.01); *F04D 17/04* (2013.01); *F04D 29/0473* (2013.01); *F04D 29/057* (2013.01); *F04D 29/0513* (2013.01); *F04D 29/4206* (2013.01); *F04D 29/441* (2013.01); *F04D 29/601* (2013.01)

(58) Field of Classification Search
CPC .... F04D 29/601; F04D 29/0513; F04D 13/06; F04D 29/44; H02K 5/20; H02K 5/203; H02K 9/19; H02K 1/20
See application file for complete search history.

(56) References Cited

U.S. PATENT DOCUMENTS

2020/0256344 A1* 8/2020 Sakota ..... F04D 25/06
2021/0215171 A1* 7/2021 Fujita ..... F04D 29/4206

* cited by examiner

COMPRESSOR WITH COOLED AIR PASSAGE AND LIQUID COOLANT PASSAGE IN AXIAL HEAT EXCHANGER ARRANGEMENT

TECHNICAL FIELD

The present disclosure generally relates to a compressor and, more particularly, relates to a compressor with a cooled air passage and a liquid coolant passage that are arranged in an axial heat exchanger arrangement.

BACKGROUND

Various systems include a compressor for supplying a compressed fluid. For example, fuel cell systems often include a fuel cell compressor for compressing air before it is fed to the fuel cell stack. This can increase operating efficiency of the fuel cell system.

However, conventional compressors may suffer from various deficiencies. For example, some compressors may include bearings that are fluid-cooled. Cooling the bearing (s) may prove challenging, leading to inefficient operation and/or premature wear. Additionally, cooling systems within conventional compressors may be bulky. Furthermore, manufacture of these compressors may be expensive and inefficient.

Thus, it is desirable to provide a compressor with a bearing cooling system that provides improved cooling performance. It is further desirable for the bearing cooling system to be highly compact and manufacturable. Other desirable features and characteristics of the present disclosure will become apparent from the subsequent detailed description and the appended claims, taken in conjunction with the accompanying drawings and this background discussion.

BRIEF SUMMARY

In one embodiment, a compressor device is disclosed that includes a housing, a rotating group with a compressor wheel, and a bearing that supports rotation of the rotating group within the housing about an axis of rotation. The compressor device also includes a motor that drives rotation of the rotating group about the axis of rotation. Furthermore, the compressor device includes a motor cooling system that provides a first flow of a first fluid through the housing for cooling the motor. The motor cooling system includes a first fluid flow section at a first axial position. The first fluid flow section extends in a downstream direction radially with respect to the axis of rotation. Furthermore, the compressor device includes a bearing cooling system that provides a second flow of a second fluid through the housing for cooling the bearing. The bearing cooling system includes a second flow section at a second axial position that is spaced apart axially from the first axial position. The second flow section extends in a downstream direction radially with respect to the axis of rotation. Moreover, the first flow section and the second flow section are disposed in a heat exchanger arrangement configured to transfer heat between the second fluid and the first fluid.

In another embodiment, a method of manufacturing a compressor device is disclosed. The method includes housing a rotating group of the compressor device within a housing of the compressor device, wherein the rotating group includes a compressor wheel. The method also includes housing a motor of the compressor device in the housing, wherein the motor is configured to drive rotation of the rotating group about an axis of rotation. Moreover, the method includes supporting rotation of the rotating group within the housing about the axis of rotation with a bearing of the compressor device. Also, the method includes providing a motor cooling system that provides a first flow of a first fluid through the housing for cooling the motor. The motor cooling system includes a first fluid flow section at a first axial position. The first fluid flow section extends in a downstream direction radially with respect to the axis of rotation. The method further includes providing a bearing cooling system that provides a second flow of a second fluid through the housing for cooling the bearing. The bearing cooling system includes a second flow section at a second axial position that is spaced apart axially from the first axial position. The second flow section extends in a downstream direction radially with respect to the axis of rotation. The method additionally includes disposing the first flow section and the second flow section in a heat exchanger arrangement configured to transfer heat between the second fluid and the first fluid.

In a further embodiment, a compressor device includes a housing that includes a compressor housing, a motor housing, and an internal member, wherein the compressor housing has an inlet, a diffuser area, and a volute passage, and wherein the internal member has a diffuser portion proximate the diffuser area and a thrust bearing portion. The compressor device also includes a rotating group with a compressor wheel and a bearing that supports rotation of the rotating group within the housing about an axis of rotation. The compressor device further includes a motor that drives rotation of the rotating group about the axis of rotation such that the compressor wheel compresses air flowing from the inlet, through the diffuser area, and into the volute passage. Moreover, the compressor device includes a motor cooling system that provides a first flow of a liquid coolant through the motor housing for cooling the motor and partly through the internal member of the housing. The motor cooling system includes a first fluid flow section at a first axial position. The first fluid flow section extends in a downstream direction radially with respect to the axis of rotation. Furthermore, the compressor device includes a bearing cooling system that receives an amount of the air from the volute passage and provides a second flow of the air through the housing for cooling the bearing. The bearing cooling system includes a second flow section at a second axial position that is spaced apart axially from the first axial position. The second flow section extends in a downstream direction radially with respect to the axis of rotation. The first flow section and the second flow section are disposed in a heat exchanger arrangement configured to transfer heat from the air to the liquid coolant.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include a compressor device, such as an e-charger or electric compressor, with a bearing cooling system that provides improved bearing cooling and, thus, improved operation and wear protection for the bearing of the compressor device. The compressor device is also compact and highly manufacturable.

The compressor device may include a housing and a rotating group that rotates about an axis of rotation within the housing. The compressor device may include a bearing, such as an air bearing, that supports rotation of the rotating group within the housing. The compressor device may further include a motor, such as an electric motor, that drives rotation of the rotating group about the axis of rotation. Furthermore, the compressor device may include a motor cooling system through which a first coolant fluid flows to cool the motor. The compressor device may additionally include a bearing cooling system through which a second coolant fluid flows to cool the bearing. The motor cooling system and the bearing cooling system may include respective portions that are disposed together in a heat exchanger arrangement within the housing for transferring heat between the first and second fluids. In some embodiments, one or more flow sections of the motor cooling system may be disposed in a heat exchanger arrangement with one or more flow sections of the bearing cooling system, wherein the flow sections are spaced apart along the axis of the compressor device. In further embodiments, a flow section may be disposed between first and second flow sections of the motor cooling system with respect to the axis of rotation. The motor cooling system and the bearing cooling system may be configured such that heat is transferred from the second coolant fluid (of the bearing cooling system) to the first coolant fluid (of the motor cooling system) to cool the second coolant fluid. Ultimately, this may increase operating efficiency and provide wear protection for the compressor device.

Also, in some embodiments, one or more parts may define plural areas of the compressor device. For example, a single part may define at least a portion of the compressor flow passage (e.g., portions of a diffuser area and/or volute flow passage) and may also define portions that support the bearing of the compressor device. Furthermore, in some embodiments, this part may define portions of the bearing cooling system and/or the motor cooling system. These features can improve manufacturability, lower part count, and/or provide additional advantages.

Figure 1:
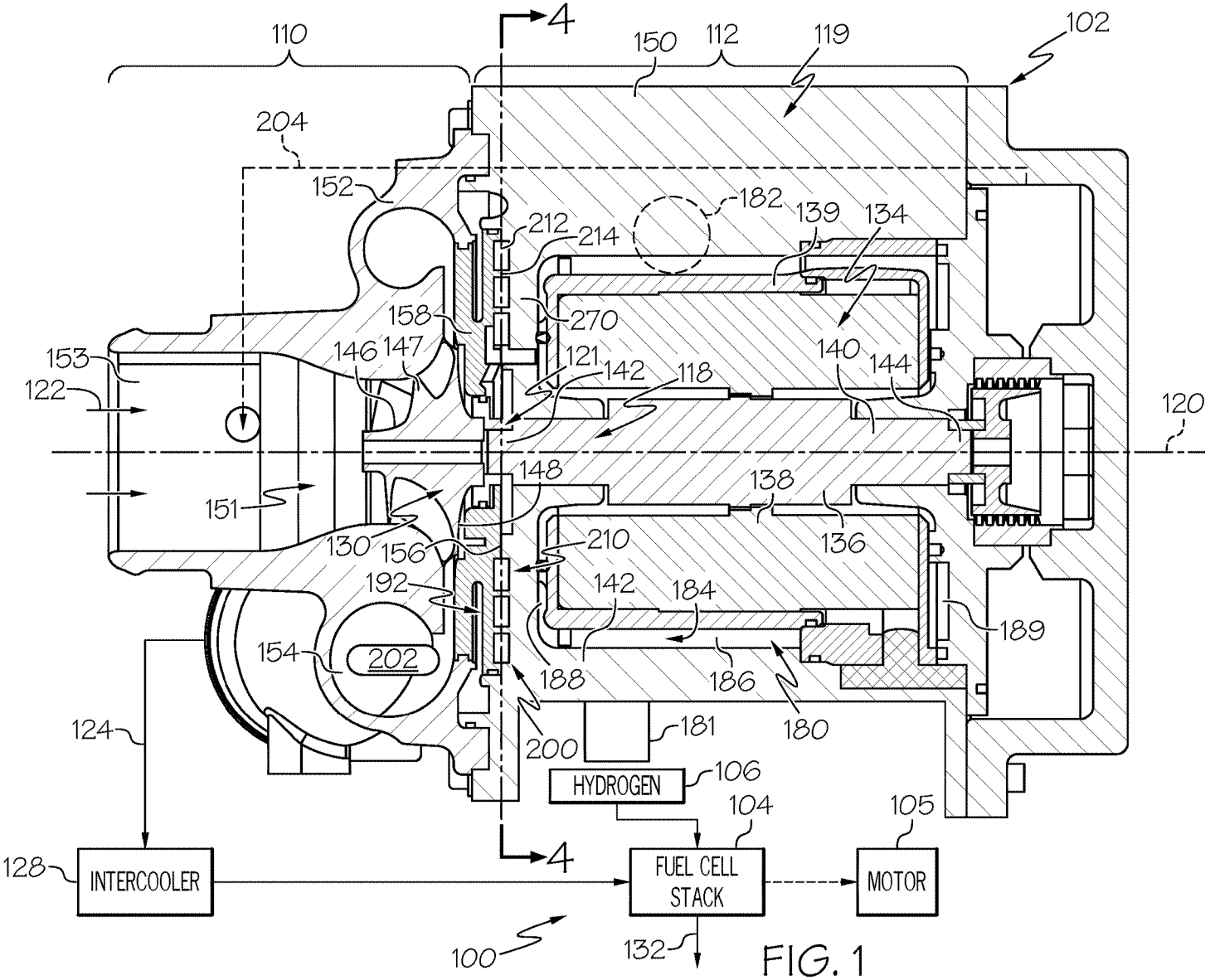
FIG. 1 is schematic view of a compressor device according to example embodiments of the present disclosure shown incorporated within a fuel cell system.

Referring initially to FIG. 1, a compressor device 102 is shown according to example embodiments. The compressor device 102 may be an e-charger or electric motorized compressor device. Also, as shown, the compressor device 102 may be incorporated within a fuel cell system 100; however, it will be appreciated that the compressor device 102 may be incorporated in another system without departing from the scope of the present disclosure.

In some embodiments, the fuel cell system 100 may be included in a vehicle, such as a car, truck, sport utility vehicle, van, motorcycle, etc. However, it will be appreciated that the fuel cell system 100 may be configured for a different use without departing from the scope of the present disclosure.

The fuel cell system 100 may include a fuel cell stack 104 containing a plurality of fuel cells. Hydrogen may be supplied to the fuel cell stack 104 from a tank 106, and oxygen may be supplied to the fuel cell stack 104 to generate electricity by a known chemical reaction. The fuel cell stack 104 may generate electricity for an electrical device, such as an electric motor 105. As stated, the fuel cell system 100 may be included in a vehicle; therefore, in some embodiments, the electric motor 105 may convert the electrical power to mechanical power to drive and rotate an axle (and, thus, one or more wheels) of the vehicle. Oxygen may be provided to the fuel cell stack 104, at least in part, by the compressor device 102.

Figure 2:
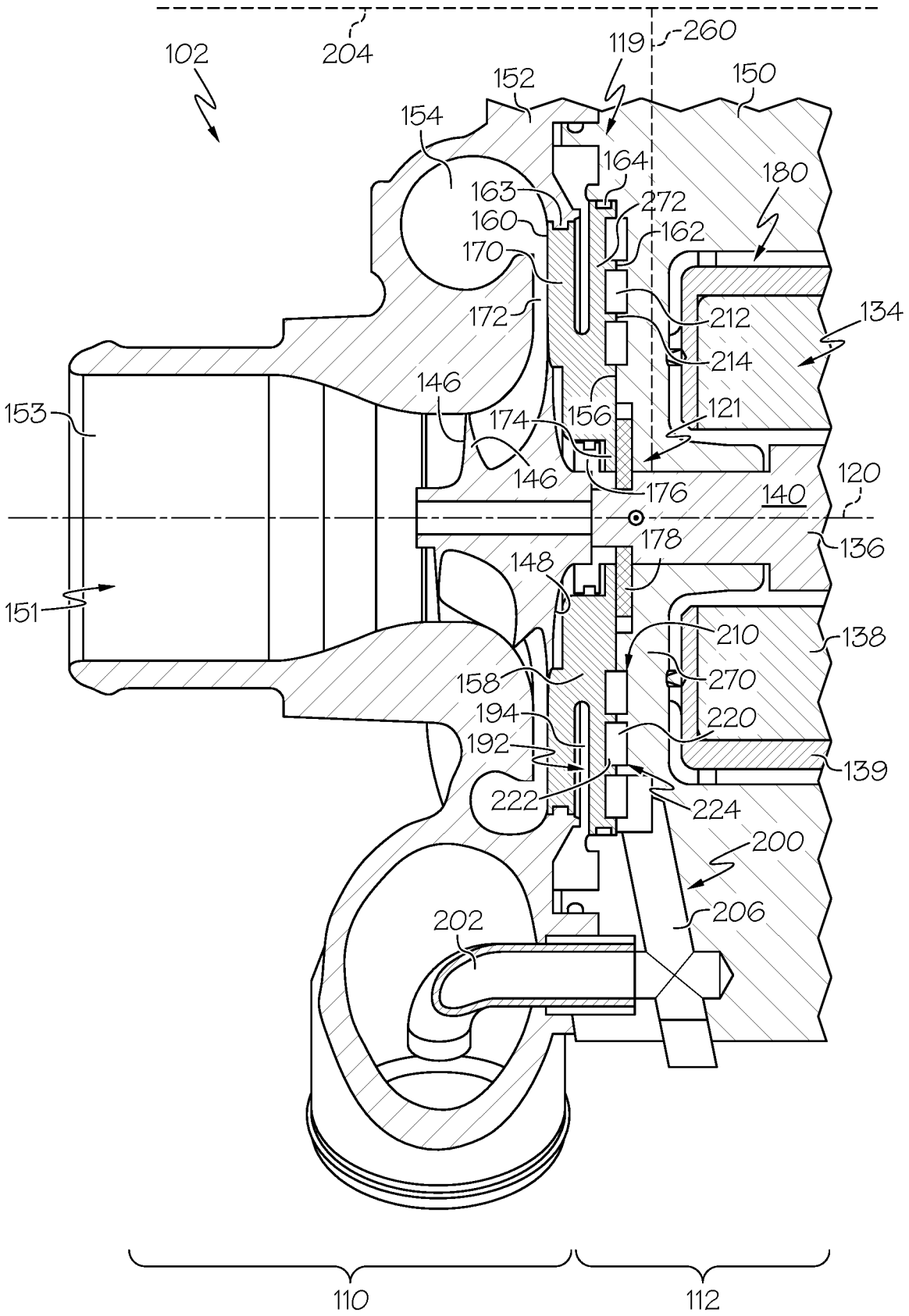
FIG. 2 is a first longitudinal section view of the compressor device of FIG. 1.
Figure 3:
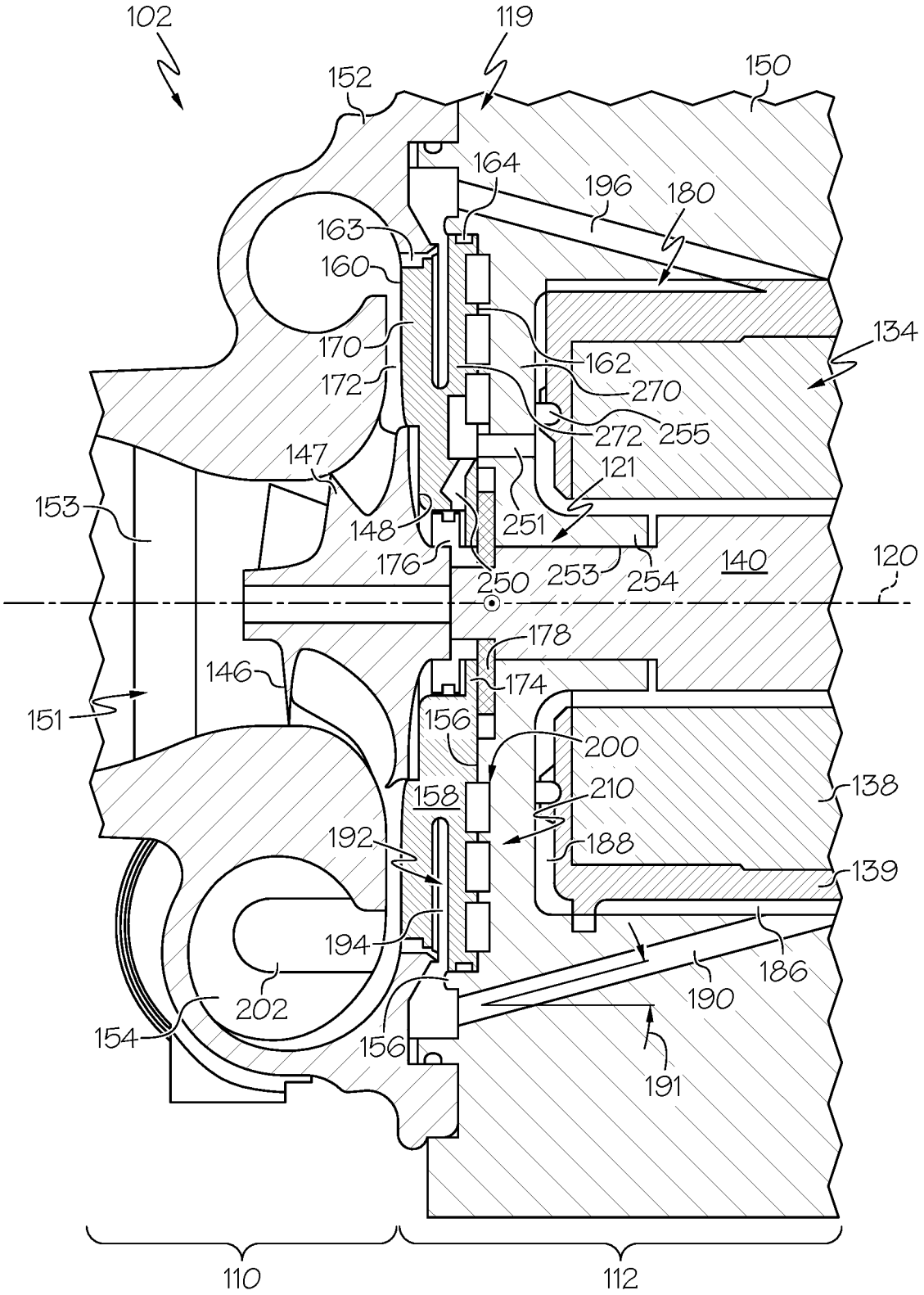
FIG. 3 is a second longitudinal section view of the compressor device of FIG. 1.

As shown in FIGS. 1-3, the compressor device 102 may generally include a rotating group 118 and a housing 119 that houses and encloses the rotating group 118. The rotating group 118 is supported for rotation within the housing 119 about an axis of rotation 120 by one or more bearings 121.

The rotating group 118 may generally include an elongate, cylindrical shaft 140 with a first end 142 and a second end 144. The rotating group 118 may also include a compressor wheel 130 that is fixed to the first end 142 of the shaft 140. The compressor wheel 130 may include a front side 146 with a plurality of blades 147 and an opposite back side 148 that faces toward the second end 144. In some embodiments, the bearing(s) 121 may be configured as a plain bearing, an air bearing, and/or an oil-less bearing.

The compressor device 102 may define a motor section 112. The motor section 112 may include an electric motor 134 that is housed within a motor housing 150 of the housing 119. The motor 134 may generally include a rotor 136 and a stator 138 of a known type. The rotor 136 may be mounted on the shaft 140, and the stator 138 may encircle the rotor 136. The rotor 136 and stator 138 may be housed and encased within a thin-walled motor case 139. The motor case 139 of the motor 134 may be fixed and supported within the motor housing 150 with one or more gaps therebetween. The first end 142 and second end 144 of the shaft 140 may extend out respective sides of the motor case 139 and may be supported in the motor housing 150 by the bearing 121. Thus, the motor 134 may be operatively attached to the rotating group 118 for driving rotation of the rotating group 118 within the housing 119 about the axis 120.

The compressor device 102 may also include a compressor section 110. The compressor section 110 may include the compressor wheel 130 that is housed within a compressor housing 152 of the housing 119. The compressor housing 152 may define a compressor flow path 151 with a tubular inlet 153 that is centered on the axis 120. The inlet 153 may have a variety of shapes and profiles without departing from the scope of the present disclosure. The flow path 151 of the compressor housing 152 may also define at least part of a volute passage 154 that extends about the axis 120. In some embodiments, the compressor housing 152 may be a unitary (single piece) component that is manufactured via casting operations, via additive manufacturing processes, or otherwise. The compressor housing 152 may be fixedly attached to an axial face 156 of the motor housing 150 and may cover over the front side 146 of the compressor wheel 130. The compressor wheel 130 may be driven in rotation by the motor 134 about the axis 120 within the compressor housing 152 of the compressor section 110.

In some embodiments, the compressor device 102 may include an intermediate housing member 158. The intermediate housing member 158 may define portions of the housing 119 as well as portions of the bearing 121 in some embodiments. Thus, the intermediate housing member 158 may be referred to as a "thrust cover" and will be hereafter referred to as such. The thrust cover 158 may be a unitary, one-piece, disc-like part in some embodiments. The thrust cover 158 may include a first axial face 160 and a second axial face 162. The thrust cover 158 may be disposed between and/or at a transition between the compressor section 110 and the motor section 112. The first axial face 160 may face toward the compressor housing 152 and the back side 148 of the compressor wheel 130. A first outer radial edge portion 163 may oppose, engage, and/or fixedly attach to the compressor housing 152, and a second outer radial edge portion 164 may oppose, engage, and/or fixedly attach to the motor housing 150. The second axial face 162 may oppose, engage, and/or fixedly attach to the axial face 156 of the motor housing 150. As such, a diffuser portion 170 of the thrust cover 158, in cooperation with the compressor housing 152, may define a diffuser area 172 of the compressor device 102 that is disposed outward radially from the outer radial edge of the compressor wheel 130. Further outward, the first axial face 160 of the thrust cover 158 may cooperatively define an inlet into the volute passage 154. Also, the second axial face 162 and other portions of the thrust cover 158 may define one or more fluid passageways, segments, chambers, etc. as will be described in detail below. Furthermore, the thrust cover 158 may include a thrust bearing portion 174 on an inner radial portion thereof for defining and/or supporting the bearing 121. As shown, the thrust bearing portion 174 may be received axially between an annular compressor collar 176 and a thrust disc 178 of the bearing 121.

During operation of the compressor device 102, an inlet airstream (represented by arrows 122 in FIG. 1) may flow into the inlet 153, and the inlet airstream 122 may be compressed as it flows downstream between the compressor wheel 130 and the compressor housing 152, through the diffuser area 172, and into the volute passage 154. A compressed airstream (represented by arrow 124) may exit the volute passage 154 and may be directed to an intercooler 128 and then to the fuel cell stack 104 for boosting the operating efficiency of the fuel cell system 100.

Furthermore, an exhaust gas stream (represented by arrow 132) from the fuel cell stack 104 may be exhausted to atmosphere as represented in FIG. 1. Stated differently, the exhaust gas stream 132 may be directed away from the compressor device 102. Accordingly, the rotating group 118 may be driven in rotation without the need for a turbine. In other words, the rotating group 118 may be turbine-less and may be driven solely by the electric motor 134 in some embodiments. In other embodiments, the exhaust gas stream 132 may be directed back toward the compressor device 102, for example, to drive rotation of a turbine wheel included in the rotating group 118. This may, in turn, drive rotation of the compressor wheel 130, for example, to assist the electric motor 134.

Furthermore, the compressor device 102 may include a motor cooling system 180. Generally, the motor cooling system 180 may provide a first flow of a first fluid (e.g., a liquid coolant) through the housing 119 for cooling the motor 134. The motor cooling system 180 may also be routed through the housing 119 for cooling the bearing 121 and surrounding structures as will be discussed. The motor cooling system 180 may include an inlet 181 and an outlet 182 (both represented schematically in FIG. 1) and a plurality of passages, chambers, etc. forming one or more continuous fluid paths connecting the inlet 181 and outlet 182.

As shown in FIG. 1, the motor cooling system 180 may include a coolant jacket 184 defined by the gap between the motor case 139 and the motor housing 150. The coolant jacket 184 may be subdivided into an outer diameter portion 186, a first axial end portion 188, and a second axial end portion 189 that collectively surround the motor 134. As shown in FIG. 3, the motor cooling system 180 may further include a first axial channel 190 that extends through the motor housing 150, generally axially from the outer diameter portion 186 toward the compressor section 110. The first axial channel 190 may be straight and may have a rounded (circular) cross section (perpendicular to the flow direction). Also, the first axial channel 190 may extend axially to the axial face 156 of the motor housing 150 at an angle 191 relative to the axis 120. The first axial channel 190 may be open at the axial face 156, at which the first axial channel 190 fluidly connects and intersects with a radial flow section 192 of the motor cooling system 180.

The radial flow section 192 may be at least partly defined by an annular groove 194 in the thrust cover 158. The groove 194 may be defined between the first and second outer radial edge portions 163, 164 of the thrust cover 158. As such, the groove 194 may extend radially inward from the outer diameter edge of the thrust cover 158. Also, the radial flow section 192 may extend circumferentially about the axis 120. The radial flow section 192 may fluidly connect with a second axial channel 196 (FIG. 3) of the motor cooling system 180. The second axial channel 196 may extend from the axial face 156 and into the motor housing 150, generally axially away from compressor section 110 to fluidly connect back with the outer diameter portion 186 of the cooling jacket 184. As represented in FIG. 3, the second axial channel 196 may be disposed on an opposite side of the axis 120 from the first axial channel 190 (e.g., spaced 180 degrees apart about the axis 120). Also, the second axial channel 196 may be disposed at an angle (e.g., the inverse of the angle 191 of the first axial channel 190).

Accordingly, the motor cooling system 180 may define one or more fluid flow paths for a first coolant (e.g., a liquid coolant) to flow from the inlet 181 to the outlet 182 in a downstream direction. During operation, the first fluid may flow from the inlet 181 and to the coolant jacket 184. From there, the first fluid may flow through the first axial channel 190 and into the radial flow section 192. There, the fluid may flow about the axis 120 circumferentially and radially inward toward the axis 120 through the thrust cover 158. Moving further downstream, the fluid may flow to the second axial channel 196, return to the coolant jacket 184, and then flow to the outlet 182.

Additionally, the compressor device 102 may include a bearing cooling system 200. Generally, the bearing cooling system 200 may provide a second flow of a second fluid (e.g., air or other gas coolant) through the housing 119 for cooling the bearing 121. The bearing cooling system 200 may also be routed through the housing 119 to be disposed in a heat exchanger arrangement with the motor cooling system 180 as will be discussed.

The bearing cooling system 200 may include an inlet 202 and an outlet 204. In some embodiments, the inlet 202 and/or outlet 204 may be in fluid communication with the compressor flow path 151. For example, as shown in FIG. 1, the inlet 202 may be fluidly connected to the compressor flow path 151 (e.g., at the volute passage 154) to receive airflow therefrom, and the outlet 204 may be fluidly connected to return flow back to the compressor flow path 151 (e.g., at the inlet 153). Also, the bearing cooling system 200 may include a plurality of passages, chambers, etc. forming one or more continuous fluid paths connecting the inlet 202 and the outlet 204.

As shown in FIG. 2, the inlet 202 may include a pitot tube (a "reverse" pitot tube) that is disposed within and fluidly connected to the volute passage 154. Also, the bearing cooling system 200 includes one or more bores 206 forming a passage that extends from the axial face 156 and radially inward through the motor housing 150.

The bearing cooling system 200 may further include a flow section 210. In some embodiments, the flow section 210 may be cooperatively defined by the second axial face 162 of the thrust cover 158 and the axial face 156 of the motor housing 150. For example, the second axial face 162 and/or the axial face 156 may include one or more recesses 212 that is/are defined between one or more walls 214. In the illustrated embodiments, for example, both the axial faces 156, 162 include respective recesses 212 and walls 214 that are aligned axially (i.e., along the axis 120) to define various segments through the flow section 210 of the bearing cooling system 200. Stated differently, as indicated in FIG. 2, the axial face 156 may include a first recess 220 that aligns axially with a second recess 222 of the axial face 162 to cooperatively define a segment 224 of the flow section 210. As shown, there may be a plurality of segments 224 of the flow section 210 defined between the axial faces 156, 162.

As represented in FIGS. 4-7, the segments 224 of the flow section 210 may be arranged together as a continuous flow path. As shown, the segments 224 may have a variety of arrangements without departing from the scope of the present disclosure. A flow path through the flow section 210 as well as the downstream direction of the flow path is indicated in each of the embodiments of FIGS. 4-7 by arrow 226. As shown, the flow path 226 may extend in the downstream direction radially with respect to the axis of rotation 120. More specifically, in some embodiments, the flow path 226 may extend in the downstream direction radially inward with respect to the axis of rotation 120. Also, the flow path 226 of the flow section 210 may extend from one side of the axis of rotation 120 to an opposite side of the axis of rotation 120 as shown in FIGS. 4-7. In some embodiments, the flow path 226 may extend both radially and circumferentially about the axis of rotation 120. The flow path 226 may extend arcuately and/or linearly and straight as it extends in the downstream direction.

Figure 4:
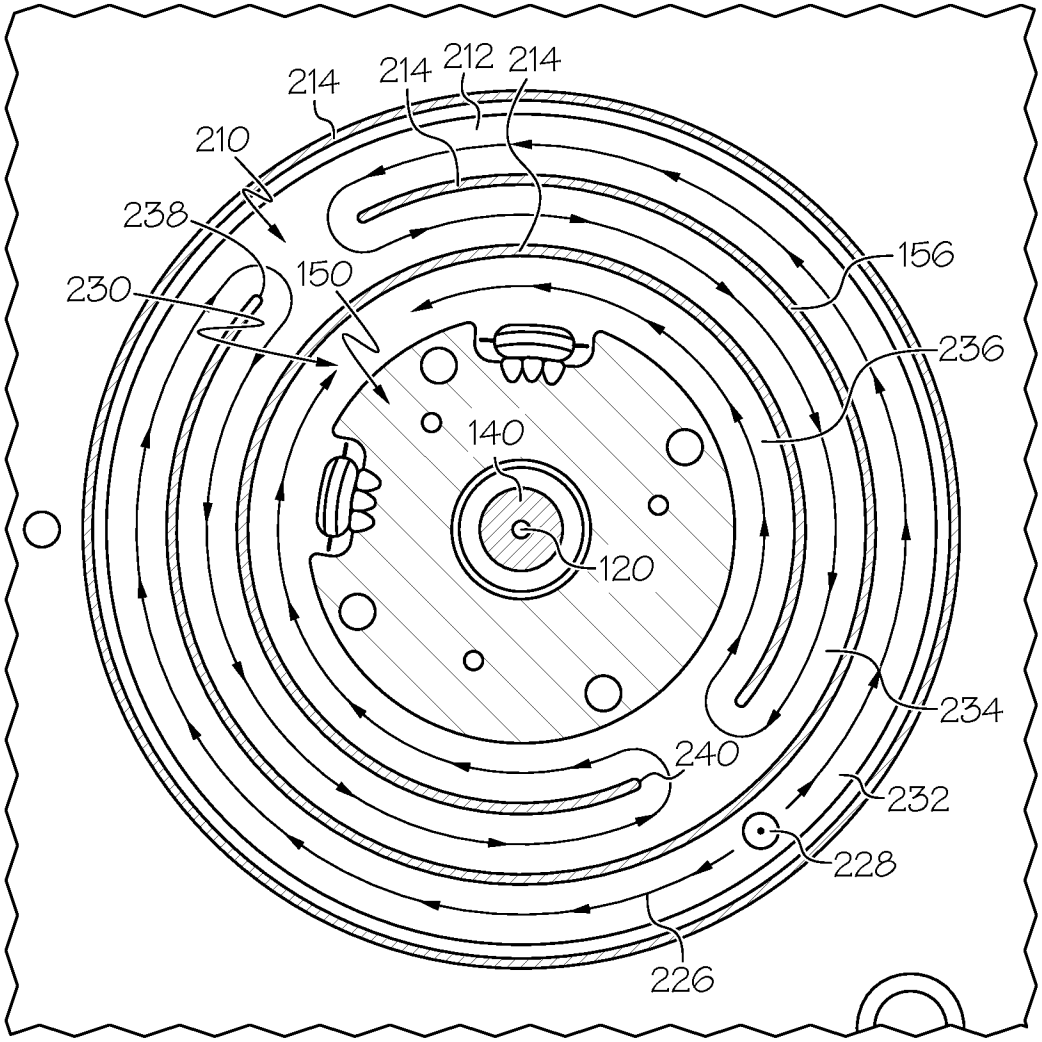
FIG. 4 is an axial section view of the compressor device taken along the line 4-4 of FIG. 1.
Figure 7:
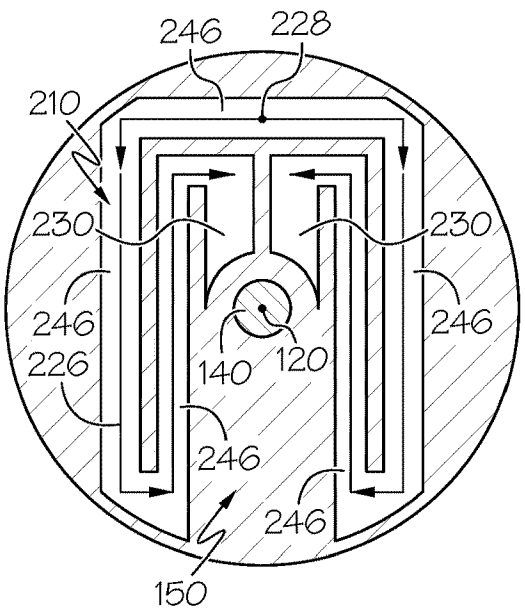
FIG. 7 is an axial section view of the compressor device according to additional example embodiments of the present disclosure.

In particular, in the embodiments of FIG. 4, the flow path 226 through the flow section 210 includes a plurality of arcuate segments, including a first arcuate segment 232, a second arcuate segment 234, and a third arcuate segment 236 that each extend arcuately about the axis 120. The arcuate segments 232, 234, 236 may each have distinct radii and the radius of each may remain substantially constant with respect to the axis of rotation 120. The arcuate segments 232, 234, 236 may be concentric and centered on the axis 120 with the second arcuate segment 234 disposed radially between the first and third arcuate segments 232, 236. Also, there may be a first circumferential gap 238 in one of the walls 214, and the gap 238 may fluidly connect the first and second arcuate segments 232, 234. Likewise, there may be a second circumferential gap 240 in another wall 214, and the gap 240 may fluidly connect the second and third arcuate segments 234, 236. The flow path 226 may have an input area 228 defined within the first (outer) arcuate segment 232, and the flow path 226 may extend downstream along a tortuous path, circumferentially in opposite directions through the first arcuate segment 232, then through the gap 238 radially inward into the second arcuate segment 234, then circumferentially in opposite directions through the second arcuate segment 234, then through the gap 240 radially inward into the third arcuate segment 236, and ultimately to an output area 230 of the flow section 210.

Figure 6:
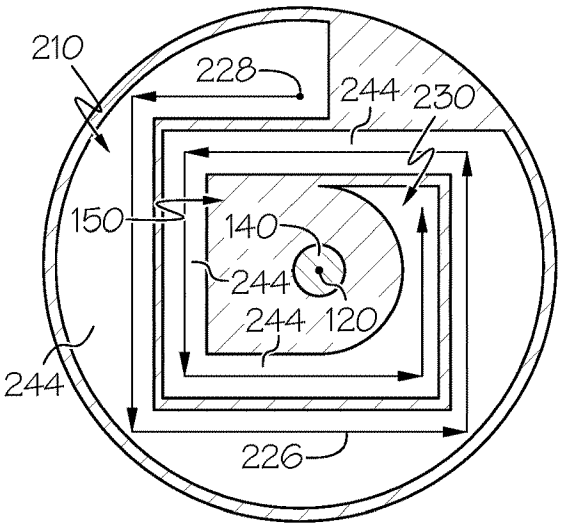
FIG. 6 is an axial section view of the compressor device according to additional example embodiments.
Figure 5:
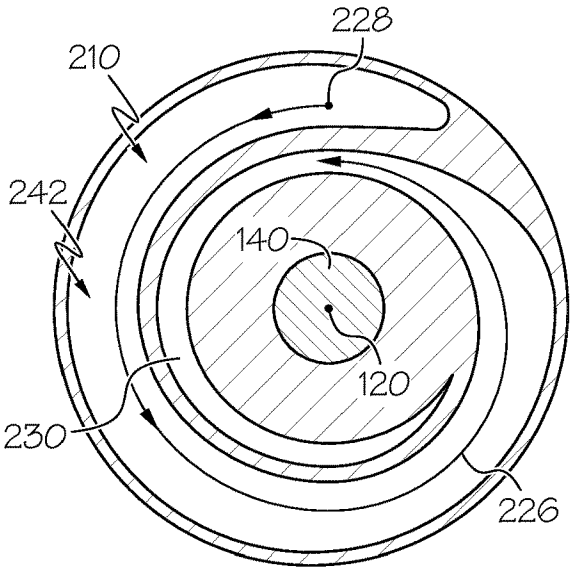
FIG. 5 is an axial section view of the compressor device according to additional example embodiments.

In additional embodiments represented in FIG. 5, the flow section 210 may include an arcuate segment 242 that extends circumferentially and radially inward, spiraling toward the axis 120 from its input area 228 to its output area 230. In further embodiments represented in FIG. 6, the flow section 210 may include a plurality of longitudinally straight segments 244 that are connected end-to-end so as to extend from one side of the axis 120 to the other from its input area 228 to its output area 230. As shown in FIG. 6, the flow path 226 may gradually extend radially inward with respect to the axis 120 (i.e., gradually get closer to the axis 120) as the flow path 226 extends about the axis 120. Moreover, in embodiments represented in FIG. 7, the flow section 210 may include a plurality of longitudinally straight segments 246 that are connected end-to-end so as to extend from one side of the axis 120 to the other and back. As shown, the input area 228 may be on one side and disposed radially outboard. The flow path 226 may split in opposite directions from the input area 228, turn perpendicularly and extend to the opposite side of the axis 120, turn again perpendicularly and extend back to the original side of the axis 120. As shown, the flow path 226 may gradually extend radially inward with respect to the axis 120 (i.e., gradually get closer to the axis 120).

As shown in FIG. 3, the bearing cooling system 200 may further include a first bearing injection path 250 that fluidly connects the output area 230 to thrust and/or journal components of the bearing 121. For example, the first bearing injection path 250 may be a passage extending radially inward through the inner diameter portion of the thrust cover 158 to fluidly connect the output area 230 of the flow section 210 to gaps on one axial side of the thrust disc 178. Thus, fluid (air) from the compressor flow path 151 may be provided via the bearing cooling system 200 to cool the bearing 121. Also, the bearing cooling system 200 may also include a second bearing injection path 251 that fluidly connects the output area 230 to thrust and/or journal components of the bearing 121. For example, the second bearing injection path 251 may include a bore extending axially toward the motor 134 to fluidly connect the output area 230 of the flow section 210 to gaps between the motor case 139 and the motor housing 150. (There may be an annular sealing member 255 that seals and separates the liquid coolant in the first axial end portion 188 from the air provided by the second bearing injection path 251.) There may also be an axial path 253 defined between the shaft 140 and an inner radial lip 254 of the motor housing 150 that feeds the air from the second bearing injection path 251 to the other axial side of the thrust disc 178. Air in this area may also flow to the journal elements of the bearing 121 as well. Moreover, the bearing cooling system 200 may include features that define a flow path further downstream.

Accordingly, during operation, the inlet 202 of the bearing cooling system 200 may receive air from the compressor flow path 151. This air may flow downstream through the bores 206 (FIG. 2), and to the input area 228 of the flow section 210. The flow may continue radially inward along the flow path 226 of the flow section 210 and may flow to the bearing 121 via the first and second bearing injection paths 250, 251. The air may flow eventually to the outlet 204.

The outlet 204 is represented schematically in FIGS. 1 and 2. As indicated, the outlet 204 may be an elongate passage that is defined through one or more portions of the housing 119 and that extends back to fluidly connect to the inlet 153 of the compressor flow path 151. In some embodiments, the outlet 204 may extend from areas proximate the second end 144 of the shaft 140, through the motor housing 150 and/or the compressor housing 152 to fluidly connect to the inlet 153. There may also be a first end outlet branch 260 (FIG. 2). The branch 260 may be a bore extending radially. The branch 260 may extend through the motor housing 150, at an axial position between the motor 134 and the axial face 156. The branch 260 may intersect portions of the outlet 204 extending from the second end 144. As such, flow from the branch 260 may return to the inlet 153. Also, in some embodiments, at least part of the outlet 204 may extend along an exterior of the housing 119. Accordingly, the outlet 204 may return the second fluid of the bearing cooling system 200 to the inlet 153 of the compressor flow path 151, upstream of the compressor wheel 130.

The bearing cooling system 200 and the motor cooling system 180 may be disposed together in a heat exchanger arrangement such that heat transfers therebetween. For example, the flow section 210 of the bearing cooling system 200 and the axial end portion 188 of the motor cooling system 180 may be disposed at different axial positions along the axis 120, and heat may be exchanged between the fluids axially (i.e., generally along the axis 120) through an intervening portion 270 of the motor housing 150. The flow section 210 and the radial flow section 192 of the motor cooling system 180 may also be disposed at different axial positions along the axis 120, and heat may be exchanged between the fluids axially through an intervening portion 272 of the thrust cover 158. For example, in some embodiments and/or in some operating conditions, the air in the flow section 210 of the bearing cooling system 200 runs hotter than the liquid coolant in the radial flow section 192 and the axial end portion 188 of the motor cooling system 180. Accordingly, the liquid coolant may be a heat sink and may receive heat from the air in the flow section 210 during such operations.

Accordingly, the heat exchanger arrangement of the bearing and motor cooling systems 180, 200 may provide effective cooling for the bearing 121. This may ultimately increase operating efficiency of the compressor device 102. These features may also make the compressor device 102 robust for a long operating lifetime of the compressor device 102. Furthermore, the compressor device 102 may be compact and lightweight because of the features discussed above. Additionally, the compressor device 102 of the present disclosure is highly manufacturable with a relatively low part count and convenient assembly process.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A compressor device comprising:

a housing;

a rotating group with a compressor wheel;

a bearing that supports rotation of the rotating group within the housing about an axis of rotation;

a motor that drives rotation of the rotating group about the axis of rotation;

a motor cooling system that provides a first flow of a first fluid through the housing for cooling the motor, the motor cooling system including a first fluid flow section at a first axial position, the first fluid flow section extending in a radial downstream direction of the first flow of the first fluid with respect to the axis of rotation;

a bearing cooling system that provides a second flow of a second fluid through the housing for cooling the bearing, the bearing cooling system including a second flow section at a second axial position that is spaced apart axially from the first axial position, the second flow section extending in a radial downstream direction of the second flow of the second fluid with respect to the axis of rotation, the second flow section extending in a circumferential downstream direction of the second flow of the second fluid about the axis of rotation; and the first flow section and the second flow section disposed in a heat exchanger arrangement configured to transfer heat between the second fluid and the first fluid.

2. The compressor device of claim 1, wherein the second flow section includes at least one arcuate segment that extends arcuately about the axis of rotation.

3. The compressor device of claim 2, wherein the at least one arcuate segment extends both radially and circumferentially with respect to the axis of rotation.

4. The compressor device of claim 2, wherein the at least one arcuate segment extends at a constant radius with respect to the axis of rotation.

5. The compressor device of claim 1, wherein the second flow section includes a plurality of longitudinally straight segments, the plurality of straight segments connected end-to-end so as to extend from one side of the axis of rotation to an opposite side of the axis of rotation.

6. The compressor device of claim 1, wherein the second flow section extends from one side of the axis of rotation to an opposite side of the axis of rotation.

7. The compressor device of claim 1, wherein the housing includes a compressor housing with a volute passage, the compressor wheel configured to compress the second fluid as the second fluid flows into the volute passage; and wherein the bearing cooling system includes an inlet in communication with the volute passage, the second flow section being downstream of the inlet.

8. The compressor device of claim 7, wherein the compressor housing includes a compressor inlet, wherein the compressor wheel receives the second fluid via the compressor inlet; and wherein the bearing cooling system includes an outlet that returns the second fluid to the compressor inlet upstream of the compressor wheel.

9. The compressor device of claim 1, further comprising a unitary housing member with a diffuser portion for compression of the second fluid and a thrust bearing portion;

wherein the first flow section is defined in the unitary housing member.

10. The compressor device of claim 9, wherein the housing includes a motor housing that houses the motor, the motor housing having a first axial face;

wherein the unitary housing member includes a second axial face that opposes the first axial face; and wherein the first axial face and the second axial face cooperatively define at least part of the second flow section.

11. The compressor device of claim 10, wherein the first axial face includes at least one first recess and the second axial face includes at least one second recess; and wherein the at least one first recess and the at least one second recess cooperatively define at least part of the second flow section.

12. The compressor device of claim 11, wherein the motor cooling system has a third fluid flow section at a third axial position that is spaced apart axially from the first and second axial positions; and wherein the second flow section is disposed axially between the first flow section and the third flow section.

13. The compressor device of claim 1, wherein the second flow section extends inward toward the axis of rotation in the radial downstream direction.

14. The compressor device of claim 1, wherein the bearing is an air bearing.

15. A method of manufacturing a compressor device comprising:

housing a rotating group of the compressor device within a housing of the compressor device, the rotating group including a compressor wheel;

housing a motor of the compressor device in the housing, the motor configured to drive rotation of the rotating group about an axis of rotation;

supporting rotation of the rotating group within the housing about the axis of rotation with a bearing of the compressor device;

providing a motor cooling system that provides a first flow of a first fluid through the housing for cooling the motor, the motor cooling system including a first fluid flow section at a first axial position, the first fluid flow section extending in a radial downstream direction of the first flow of the first fluid with respect to the axis of rotation;

providing a bearing cooling system that provides a second flow of a second fluid through the housing for cooling the bearing, the bearing cooling system including a second flow section at a second axial position that is spaced apart axially from the first axial position, the second flow section extending in a radial downstream direction of the second flow of the second fluid with respect to the axis of rotation, the second flow section extending in a circumferential downstream direction of the second flow of the second fluid about the axis of rotation; and disposing the first flow section and the second flow section in a heat exchanger arrangement configured to transfer heat between the second fluid and the first fluid.

16. A compressor device comprising:

a housing that includes a compressor housing, a motor housing, and an internal member, wherein the compressor housing has an inlet, a diffuser area, and a volute passage, and wherein the internal member has a diffuser portion proximate the diffuser area and a thrust bearing portion;

a rotating group with a compressor wheel;

a bearing that supports rotation of the rotating group within the housing about an axis of rotation;

a motor that drives rotation of the rotating group about the axis of rotation such that the compressor wheel compresses air flowing from the inlet, through the diffuser area, and into the volute passage;

a motor cooling system that provides a first flow of a liquid coolant through the motor housing for cooling the motor and partly through the internal member of the housing, the motor cooling system including a first fluid flow section at a first axial position, the first fluid flow section extending in a radial downstream direction of the first flow of the first fluid with respect to the axis of rotation;

a bearing cooling system that receives an amount of the air from the volute passage and provides a second flow of the air through the housing for cooling the bearing, the bearing cooling system including a second flow section at a second axial position that is spaced apart axially from the first axial position, the second flow section extending in a radial downstream direction of the second flow of the second fluid with respect to the axis of rotation, the second flow section extending inward toward the axis of rotation in the radial downstream direction; and the first flow section and the second flow section disposed in a heat exchanger arrangement configured to transfer heat from the air to the liquid coolant.

17. The compressor device of claim 16, wherein the first flow section extends through the internal member of the housing, and wherein the second flow section is defined by a face of the internal member of the housing.

18. The compressor device of claim 17, wherein the motor cooling system has a third fluid flow section within the motor housing at a third axial position that is spaced apart axially from the first and second axial positions; and wherein the second flow section is disposed axially between the first flow section and the third flow section.

* * * * *